US005638989A

United States Patent [19]

Ophardt et al.

[11] Patent Number: 5,638,989

[45] Date of Patent: Jun. 17, 1997

[54] BAG FLUID DISPENSER

[76] Inventors: Heiner Ophardt, 3931 Vineyard Crescent, Vineland, Ontario, Canada, L0R 2C0; Hermann Ophardt, Lindenau 27, D-47661 Issum, Germany

[21] Appl. No.: 625,079

[22] Filed: Mar. 29, 1996

[30] Foreign Application Priority Data

Mar. 31, 1995 [CA] Canada ..... 2146102

[51] Int. Cl.[6] ..... B67P 5/06

[52] U.S. Cl. ..... 222/105; 222/181.2

[58] Field of Search ..... 222/103, 105, 222/181.1, 181.2, 181.3, 183

[56] References Cited

U.S. PATENT DOCUMENTS

| | | | |
|---|---|---|---|
| 2,858,051 | 10/1958 | Cunningham | 222/103 |
| 3,198,390 | 8/1965 | Beckman et al. | 222/105 |
| 3,199,726 | 8/1965 | Pierson | 222/105 X |
| 3,895,741 | 7/1975 | Nugent | 222/103 |
| 4,016,779 | 4/1977 | Williamson | 222/105 X |
| 4,449,646 | 5/1984 | Bonerb et al. | 222/95 |
| 4,513,885 | 4/1985 | Hogan | 222/95 |
| 4,520,948 | 6/1985 | Hampel et al. | 222/105 X |
| 4,570,827 | 2/1986 | Roggenburg, Jr. et al. | 222/105 X |
| 4,573,612 | 3/1986 | Maddison et al. | 222/105 |
| 4,690,307 | 9/1987 | Hogan | 222/95 |
| 4,883,201 | 11/1989 | Poulton | 222/105 |
| 4,998,991 | 3/1991 | Poulton | 222/181 |
| 5,100,030 | 3/1992 | Roggenburg, Jr. et al. | 222/181.2 |
| 5,195,659 | 3/1993 | Eiskant | 222/102 |
| 5,282,552 | 2/1994 | Ophardt | 222/181.3 |
| 5,323,932 | 6/1994 | Bauman | 222/105 X |
| 5,333,757 | 8/1994 | Volk | 222/94 |
| 5,377,871 | 1/1995 | Banks et al. | 222/105 X |
| 5,382,117 | 1/1995 | Rings et al. | 406/39 |
| 5,431,309 | 7/1995 | Ophardt | 222/181.3 |

*Primary Examiner*—Kevin P. Shaver
*Attorney, Agent, or Firm*—Riches, McKenzie & Herbert

[57] ABSTRACT

An improved dispensing apparatus in which a collapsible bag has a lower outlet secured to the dispenser and an upper end supported above the outlet. An improvement arises in providing a system to draw the upper end of the bag upwardly to assist in ensuring all fluid in the bag may flow under gravity to the outlet.

16 Claims, 12 Drawing Sheets

BAG FLUID DISPENSER

SCOPE OF THE INVENTION

This invention relates to fluid dispensers and more particularly to fluid dispensers utilizing collapsible bags containing fluids to be dispensed.

BACKGROUND OF THE INVENTION

Dispensers are known utilizing collapsible bags containing fluid to be dispensed, and in which the bag is held in a vertical position with an upper end supported by the dispenser above an outlet of the bag through which fluid is to exit. In such dispensers, the fluid in the bag flows towards the outlet under gravity.

A disadvantage of many such bag dispensers which has been appreciated by the present inventors is that known bags when full have their side walls distended outwardly and as the bag empties, slack develops in the side walls. As a result, as the bag is emptied, the side walls sag to hang downwardly below the outlet with the result that quantities of fluid become disposed where the side walls sag below the outlet, which fluid cannot be dispensed from the outlet.

SUMMARY OF THE INVENTION

To at least partially overcome these disadvantages of previously known devices, the present invention provides an improved dispenser in which the upper end of the bag is drawn upwardly as the fluid in the bag decreases.

An object of the present invention is to provide a dispenser for supporting bags which assists in reducing the amount of fluid which cannot be dispensed from the bag.

Another object is to provide a dispenser for dispensing fluids from collapsible bags which provides for visual inspection of the bag and labelling on the bag.

Another object is to provide a system for supporting bags so that they may be drawn upwardly.

Another object is to provide a construction for a collapsible bag for dispensing fluids which is adapted to be hung.

Another object is to provide a construction for an outlet for a bag which permits ease of filling and yet provides a convenient system for closure during storage and leak free installation in a dispensing apparatus.

Accordingly, in an aspect the present invention provides, in combination, dispensing apparatus and replaceable bag means containing fluid to be dispensed therefrom:

the bag means having an upper end and a lower end joined by collapsible side walls, hanging means on the upper end of the bag means, outlet means on the lower end of the bag means for exit of said fluid from the bag means, said dispensing apparatus having bag suspending means to suspend the bag by engaging the hanging means on the upper end of the bag means, dispensing means for fixedly holding the outlet means at a height below the upper end of the bag means, tensioning means to sufficiently tension the side walls between the lower end and the upper end of the bag means to direct fluid in the bag to assume positions disposed in the bag above the outlet means.

In another aspect, the present invention provides a dispensing apparatus comprising:

in combination, dispensing apparatus and replaceable bag means containing fluid to be dispensed therefrom:

the bag means having an upper end and a lower end joined by collapsible side walls, hanging means on the upper end of the bag means, outlet means on the lower end of the bag means for exit of said fluid from the bag means, said dispensing apparatus having bag suspending means to suspend the bag by engaging the hanging means on the upper end of the bag means, dispensing means for fixedly holding the outlet means at a height below the upper end of the bag means, tensioning means to sufficiently tension the side walls between the lower end and the upper end of the bag means to direct fluid in the bag to assume positions disposed in the bag above the outlet means, the dispensing means holding the outlet means generally vertically below the hanging means such that the bag means extends substantially vertically therebetween, the tensioning means comprises spring means which engage the side walls of the bag means between the upper end and the lower end of the bag to urge the side walls generally horizontally relative the upper end and lower end thereby tensioning the side walls between the hanging means and outlet means.

In another aspect, the present invention provides a dispensing apparatus comprising:

in combination, dispensing apparatus and replaceable bag means containing fluid to be dispensed therefrom:

the bag means having an upper end and a lower end joined by collapsible side walls, hanging means on the upper end of the bag means, outlet means on the lower end of the bag means for exit of said fluid from the bag means, said dispensing apparatus having bag suspending means to suspend the bag by engaging the hanging means on the upper end of the bag means, dispensing means for fixedly holding the outlet means at a height below the upper end of the bag means, tensioning means to sufficiently tension the side walls between the lower end and the upper end of the bag means to direct fluid in the bag to assume positions disposed in the bag above the outlet means, the tensioning means comprising spring means for biasing the suspending means upwardly thereby to draw opposite sides of the bag together and direct fluid in the bag to positions disposed in the bag above the outlet; and including stop means preventing the bag suspending means from permitting the upper end of the bag to assume a position below a minimum height position.

In a further aspect, the invention provides a dispensing apparatus for dispensing fluid from a collapsible bag means having an upper end, a lower end, outlet means approximate the lower end, and collapsible side walls, the apparatus comprising:

upper means to hold the upper end of the bag means, lower means to hold the lower end of the bag means below the upper end, tensioning means to draw portions of the side walls approximate the outlet means upwardly relative the outlet means.

BRIEF DESCRIPTION OF THE DRAWINGS

Further aspects and advantages of the present invention will be appreciated from the accompanying description taken together with the following drawings in which.

DETAILED DESCRIPTION OF THE DRAWINGS

Figure 3:
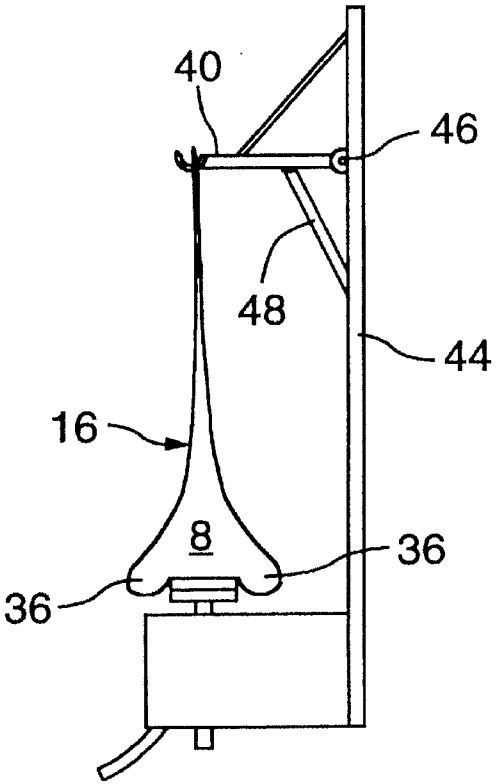
FIG. 3 is a side view of the device of FIG. 1 with the bag containing only one-third of the fluid and with the elastic cord of the device of FIG. 1 removed so as illustrate typical previous difficulties.

Throughout the drawings, same reference numerals are used to refer to similar elements.

Figure 1:
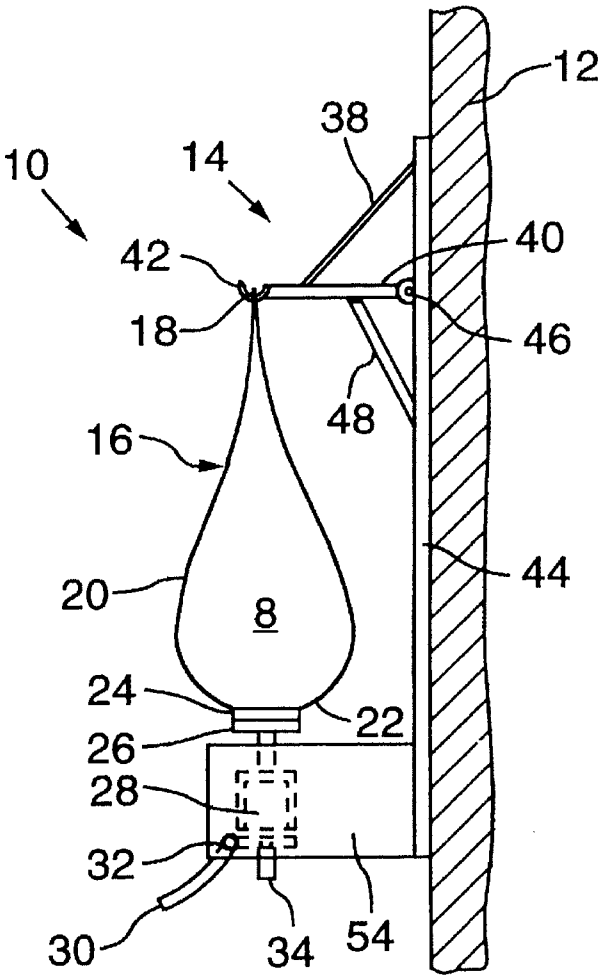
FIG. 1 is a schematic side view of the first embodiment of a fluid dispenser in accordance with a first aspect of the present invention showing a fluid containing bag filled with fluid.

Reference is made first to FIG. 1 which shows the schematic view of a wall mounted dispenser 10 secured to a wall 12. The dispenser has a bag support device generally indicated 14 to support a bag 16 at its upper end with the lower end 22 of the bag having an outlet 24 adapted to be coupled via a coupling 26 to a base 54 of the dispenser. As is known, the base 54 includes as shown in dotted lines in FIG. 1, a pump 28 which is operative to pump fluid 8 from within the bag 16 out of nozzle 34 as, for example, by downward pivoting of lever actuator 30 about its pivot 32. The bag 16 is of a type which has collapsible sides 20 which bulge outwardly in containing the fluid 8.

FIG. 1 shows bag support device 14 as comprising a support arm 40 having a hook 42 at its outer end to engage the upper end 18 of the bag. The support arm 40 is coupled to a vertical frame 44 of the dispenser for pivoting about pivot 46. A stop 48 is provided as a bracket fixed to the vertical frame 44 so as to prevent the support arm 40 from pivoting downward below the position shown in FIG. 1. An elastic cord 38 is shown extending between the support arm 40 and the vertical frame 44 above the support arm 40 which elastic cord 38 is tensioned so as to attempt to pivot the support arm 40 upwardly about pivot 46.

Figure 2:
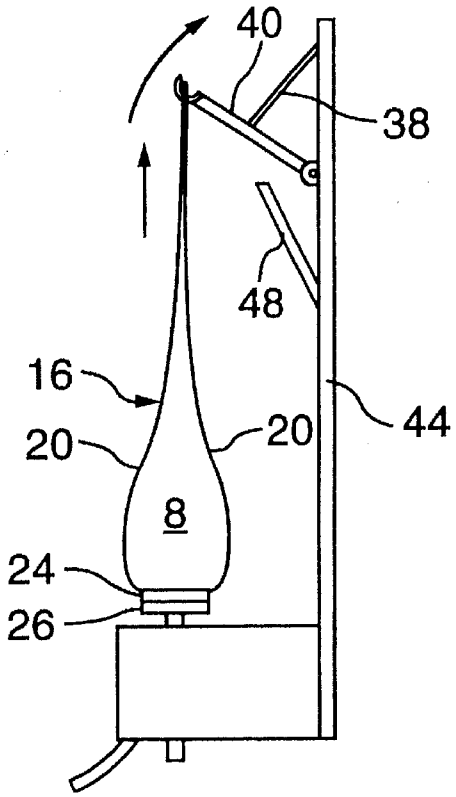
FIG. 2 is a side view of the device of FIG. 1 but with only about one-third of the fluid remaining in the bag.

Reference is now made to FIG. 2 which shows the dispenser of FIG. 1 however after substantial quantities of the fluid 8 have been pumped out of the bag 16. FIG. 2 shows the bag with approximately one-third of the fluid 8 remaining. Significantly, in FIG. 2, support arm 40 has been pivoted upwardly about pivot 46 thus drawing the upper end 18 of the bag upwardly so as to maintain the collapsible sides 20 of the bag in sufficient tension between the upper end of the bag and the lower end of the bag to direct fluid 8 in the bag 16 to assume positions disposed in the bag 16 above the outlet 24.

The operation of the device as shown in FIGS. 1 and 2 may be appreciated with reference to the device shown in FIG. 3 which is identical to the device of FIG. 2 and has the same amount of fluid 8 left in the bag 16 as in FIG. 2 however with the exception that in FIG. 3, the elastic cord 38 is not provided. As can be seen in FIG. 3, due to the reduced amount of fluid 8 in the bag 16, the remaining fluid in the bag 16 has under the influence of gravity drawn the collapsible sides 20 downward as lowered pockets 36 containing fluid 18 disposed within the bag at a level below the outlet 24 of the bag. It is to be appreciated that under the conditions as shown in FIG. 3, the fluid in the lower pockets 36 can not readily be pumped out of the dispenser. In contrast, with the device of the present invention as shown in FIG. 2, by reason of the upper end 18 of the bag being drawn upwardly by the elastic cord 38, the collapsible sides 20 of the bag are maintained in a condition that they assist in preventing fluid being received in lowered pockets such as 36 shown in FIG. 3. To the extent, the elastic cord 38 may be able to overcome the force of gravity acting on the fluid in the bag will to some extent, determine the extent to which lowered pockets 36 are prevented. It is to be appreciated, at least when substantially all the fluid 8 has been dispensed from the bag 16, that even a relatively weak elastic cord 38 may be of assistance in ensuring that the last portions of the fluid 8 may be drawn inwardly and upwardly by the collapsed sides to assist their feeding fluid by gravity to outlet 24.

Reference is now made to FIGS. 4 to 16 which illustrate a preferred second embodiment of the present invention. FIGS. 4 to 9 best show the mechanism for supporting and drawing the bag upwardly. FIGS. 10 to 16 best show the construction of the bag and its outlet and coupling of the outlet of the bag to the dispenser.

Figure 4:
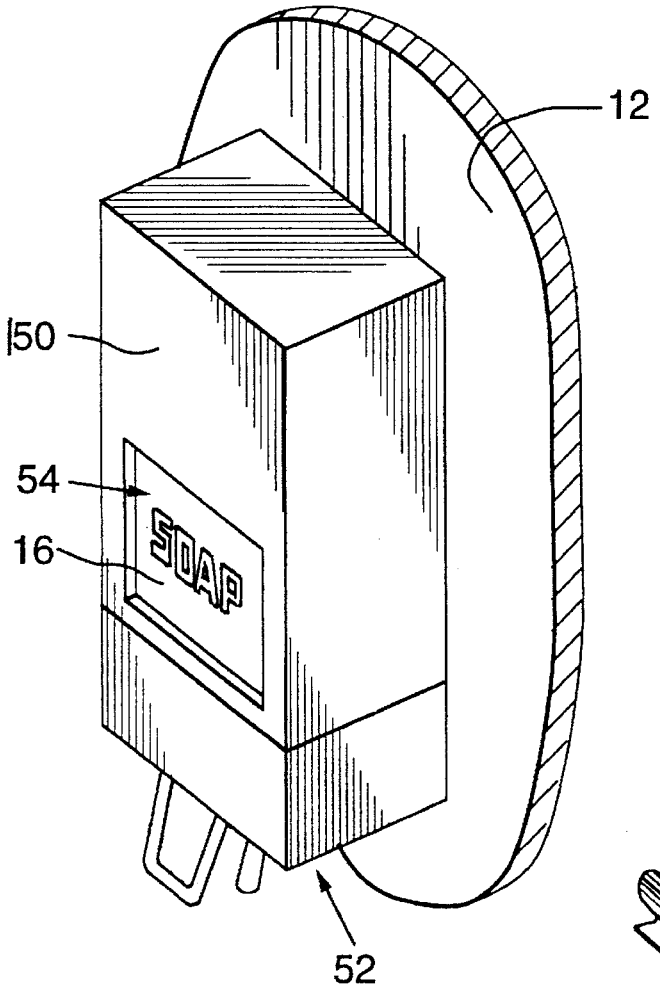
FIG. 4 is a pictorial view of the dispenser in accordance with a second embodiment of the first aspect of the present invention.

FIG. 4 shows a dispenser 10 secured to a wall 12. The dispenser has a removable cover 50 which is secured to a housing generally indicated as 52. The cover 50 preferably has a window 52 which may or may not be covered with a transparent plastic pane to permit visual inspection of the bag 16 within the dispenser and, for example, to read the label of the bag indicated as the word "soap" as seen through window 52 in FIG. 4.

Figure 5:
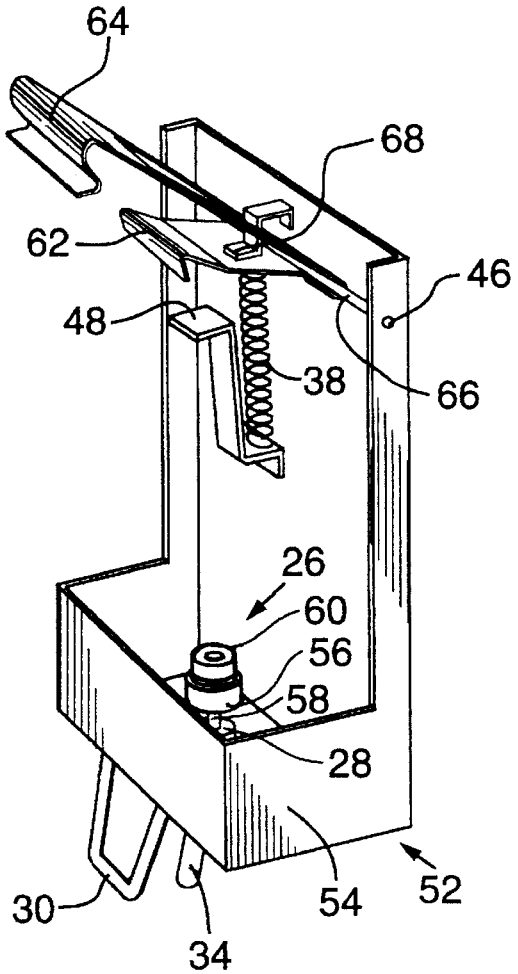
FIG. 5 is a pictorial view of the dispenser of FIG. 4 with its cover and dispensing bag removed.

FIG. 5 shows the dispenser of FIG. 4 with both the cover 50 and the bag 16 removed. Housing 52 has a base 54 which is schematically shown to carry the pump 28, the lever actuator 30 and the fluid dispensing nozzle 34. A coupling generally indicated as 26 is shown and will be described later to comprise a threaded collar 56 disposed coaxially about a feed tube 58 having an enlarged annular plug 60 at its upper end and with the feed tube 58 to connect the outlet. 24 of the bag 16 to the pump 28.

Referring to FIG. 5, the bag support device generally indicated 14 comprises a lower clamp arm 62 and an upper clamp arm 64 both mounted for pivoting on pivot rod 66 about pivot 46. A compressed coil spring 38 urges the lower clamp arm 62 upwardly. A lower stop 48 is provided to limit the extent to which the lower clamp arm 62 may pivot downwardly and an upper stop 68 is provided to limit the extent to which the lower clamp arm 62 may pivot upwardly.

Figure 6:
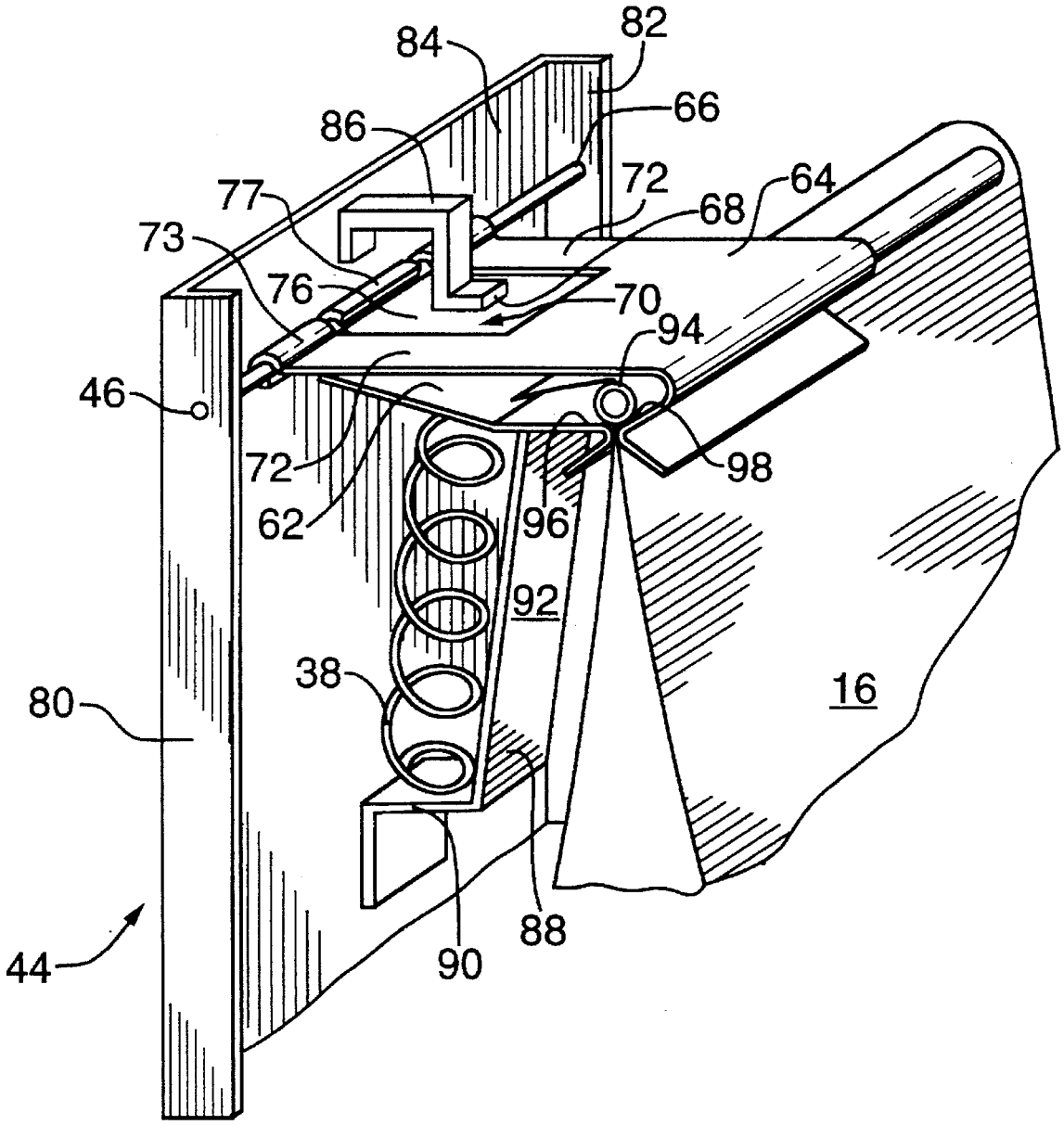
FIG. 6 is partially cut away view of the dispenser of FIGS. 4 and 5 shown engaging the upper end of a full bag.
Figure 9:
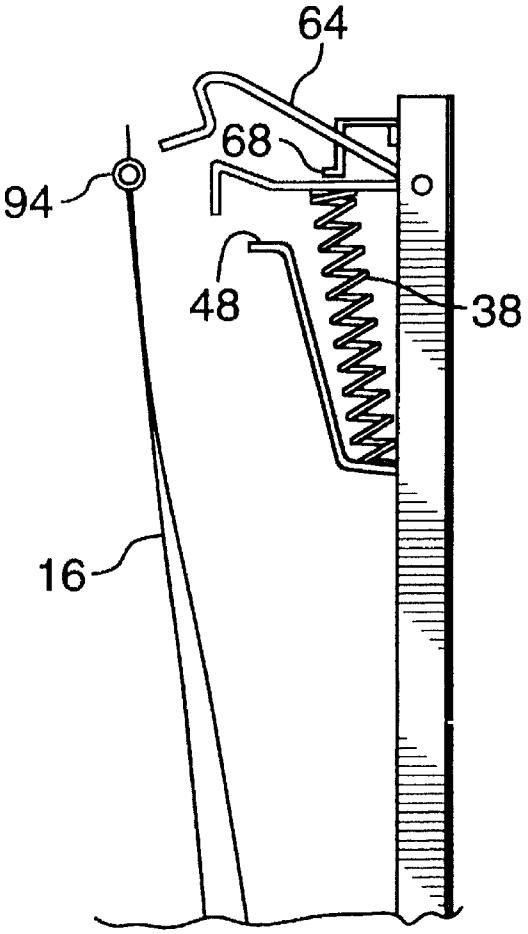
FIGS. 7, 8 and 9 show similar partial side views of the dispenser of FIG. 5 with, in FIG. 7 the bag being full, in FIG. 8 the bag being empty and in FIG. 9 the upper end of the bag is being manually held ready for coupling to the dispenser.

As best seen in FIG. 6, the upper clamp arm 64 is cut away at its rear so as to provide an opening 70 between two arms 72 with each arm terminating in cylindrical journal portions 73 extending about the pivot rod 66 and journalling the upper clamp arm for pivoting thereabout.

The lower clamp arm 62 has a central rearward arm 76 sized to be received within the opening 70 and ending with a cylindrical journal portion 77 extending about the pivot rod 66 between the arms 72 of the upper clamp arm 64 such as the lower clamp arm 62 is also mounted for pivoting about pivot rod 66.

A vertical frame 44 is shown as comprising side frames 80 and 82 connected by back frame 84 with openings in the side frames receiving the pivot rods 66 at pivot 46.

The upper stop 68 is provided as a foot on an upper bracket 86 whose rear end is secured to the frame back 84 and which extends outwardly and downwardly to present the upward stop 68 extending through the opening 70 in the upper clamp arm 64 to engage the upper surface of the lower clamp arm 62.

A lower bracket 88 is secured to the frame back 84 below the lower clamp arm. The lower bracket 88 presents a spring support plate 90 to support the lower end of the spring 38. The lower bracket 88 then extends upwardly as an arm 92 to present the lower stop 48 to engage the under surface of lower clamp arm 62.

The spring 38 shown as a helical spring sized so that the spring is compressed and will bias the lower clamp arm 62 upwardly into upper stop 68. The spring 38 is preferably sufficiently strong that it will at all times tension the sides of the bag such that pockets 36 as shown in FIG. 3 do not occur.

Figure 11:
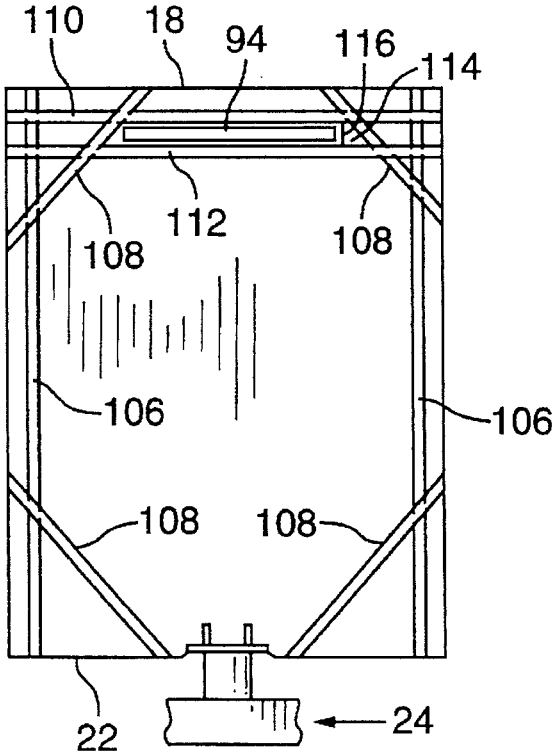
FIG. 11 shows a side view of a complete but empty bag formed from the blank of FIG. 10.

A preferred bag for use in accordance with the invention is shown in FIG. 11 and will be understand as comprising a bag 16 of flexible plastic material having at its upper end 18, a hanger tube 94 retained therein and by which hanger tube 94 the bag 16 may conveniently be secured to the bag support device 14.

Figure 7:
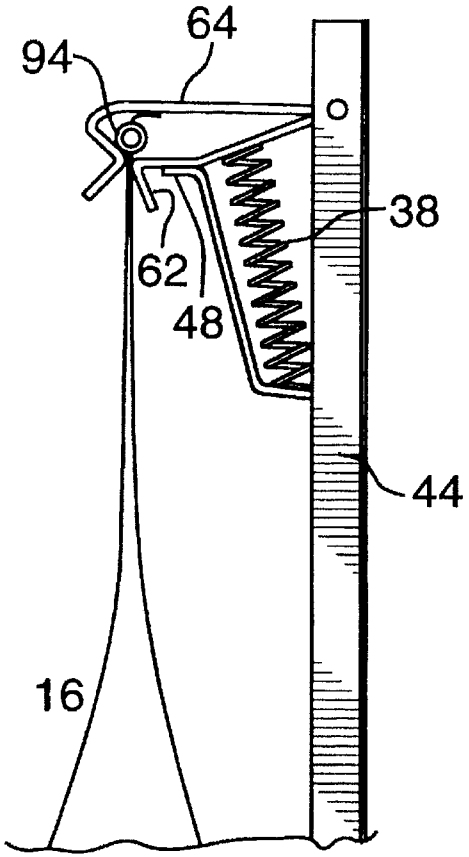

FIGS. 6 and 7 show the second embodiment of the dispenser with a full bag having its hanger tube engaged with the bag support device 14. As shown, the lower clamp arm 62 and the upper clamp arm 64 have complementary clamping surfaces indicated as 96 and 98 in FIG. 6 such that with the hanger tube 94 of the bag 16 when disposed between surfaces 96 and 98, the weight of the bag will keep the lower clamp arm 62 and upper clamp arm 62 disposed in clamping engagement about the hanger tube 94.

As best seen in FIG. 7, with a full bag having it upper end 18 secured to the bag support device 14 by means of the hanger tube 94 being engaged by the clamping surfaces 96 and 98, the weight of the fluid in the bag is such that it compresses the spring 38 with the lower clamp arm 62 being limited in downward pivoting by its under surface engaging the lower stop 48. From the position of FIGS. 7, fluid may be disposed from the bag and as the fluid is dispensed, the weight of fluid in the bag will decrease to an extent when the Spring 38 will pivot the lower clamp arm 62 upwardly. Upward pivoting of the lower clamp arm 62 is limited initially by the amount of slack in the sides of the bag and ultimately by the upper surface of the lower clamp arm 62 coming to engage the upper stop 68. As is to be appreciated and understood, the extent to which the lower clamp arm may be pivoted upwardly before stopped by the upper stop 68 will have to be chosen having regard to the relative size and configuration of the bag and the extend to which the bag needs to be drawn upwardly to ensure fluid in the bag may be dispensed from the outlet.

Figure 8:
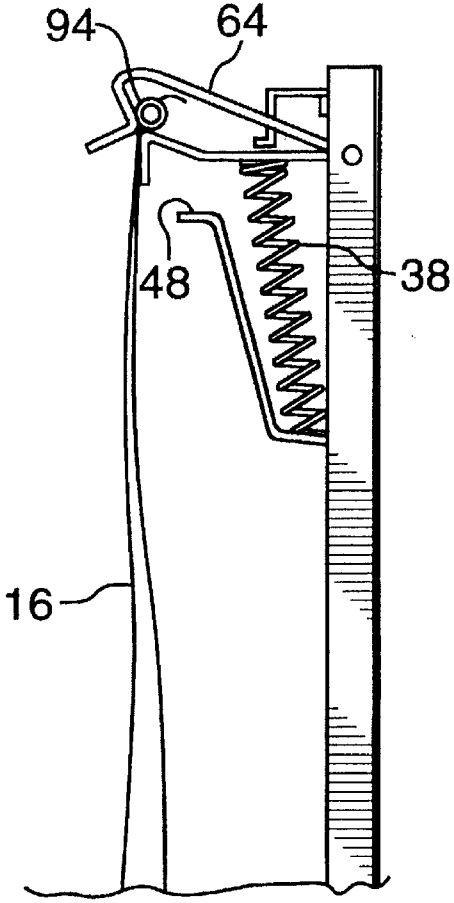

FIG. 8 shows the position in which a spring 38 has pivoted the lower clamp arm 62 upwardly of maximum into engagement with the upper stop 62. In the position in FIG. 8, when the fluid in the bag having substantially all been dispensed, to disengage the bag from the bag support device 24, a user may manually lift the upper clamp arm 64 upwardly which will permit the hanger tube 94 to be withdrawn from clamped engagement between the clamp surfaces 96 and 98. Similarly, in the position of FIG. 9, it is possible that a new full bag 16 may be engaged with the bag support device by a user manually lifting the bag 16 to place the hanger tube 94 adjacent the clamp surface 96 of the lower clamp arm 62 and then manually drawing the upper clamp arm 64 downwardly until the clamp surface 98. Neither the upper stop 68 nor the lower stop 48 are necessarily required. Providing the lower stop 48 has the advantage of not unduly compressing spring 38 and of ensuring that a bag when full is supported even with a weaker spring with its upper end at a minimum height. Upper stop 68 assists in disengaging an empty bag and engaging a new full bag.

Reference is now made to FIGS. 10 to 13 which show a preferred construction for the bag 16 for use in association with the present invention. It is to be appreciated however that while a preferred form of the bag is disclosed, the invention is not limited for use with bags of this type.

Figure 10:
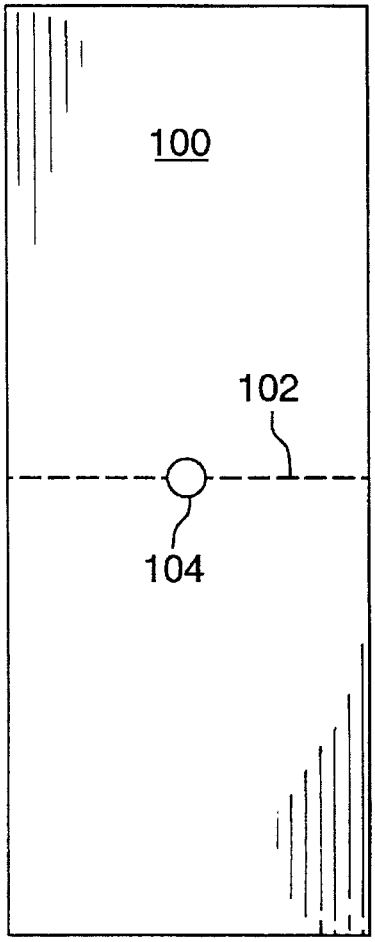
FIG. 10 shows a plan view of a blank for a bag illustrated in FIGS. 6 to 9.

FIG. 10 shows a blank comprising a thin sheet of flexible plastic material 100 shown as having a hole 104 cut therefrom and a central fold line 102.

Figure 12:
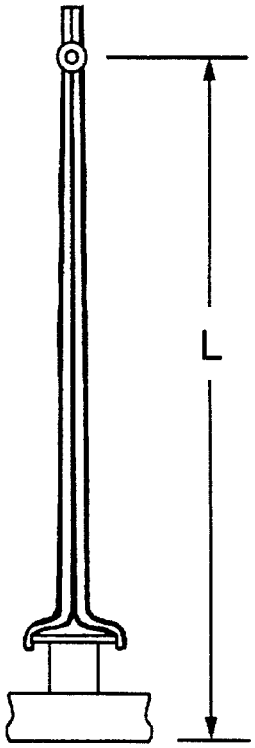
FIG. 12 shows a side view of the empty bag of FIG. 11.

The bag is formed by securing an outlet 24 to the bag in sealed communication with the hole 104 and by folding the sheet 100 about the fold line 102 so as to provide a bag as generally seen in FIGS. 11 and 12 with two sides 20 which are substantially identical and coincident. After the bag is folded, the bag then has the two sides 20 or neat sealed together along lateral seals 106 on each side, diagonal seals 108 at each corner and two transverse seals 110 and 112 near its upper end. In this manner, the seals 112, 108 and 106 form a closed interior space which together with portions of the fold line 102 about the outlet 24 and the outlet 24 forms a closed cavity open only via the hole 104 in communication with the outlet.

The seals 112 and 110 are provided so as to provide a hollow passageway 114 therebetween. At least one side 20 has a cut line 116 extending between the heat seals 110 and 112 so as to provide access to this passageway 114 and permit the insertion therein of a short length of hollow tubing to comprise the hanger tube 94.

FIG. 12 illustrates a side view of the empty bag 16 when drawn to a fully extended empty position and having a height between the exit 24 and the hanging tube 94 shown as L.

Figure 13:
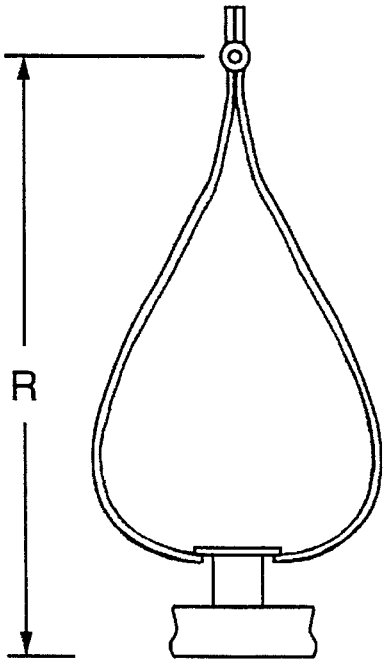
FIG. 13 shows a side view of the bag of FIG. 12 when full and suspended from its upper end.

For ease of understanding, FIG. 13 shows the bag of FIG. 12 when filled with fluid, and the bag suspended by the hanger tube 94 and showing that the height of the bag between the exit 24 and the hanger tube 94 reduces to a height R which is less than the height L of the empty bag due to the volume of the fluid 8 in the bag drawing the flexible sidewalls 20 of the bag outwardly.

Figure 14:
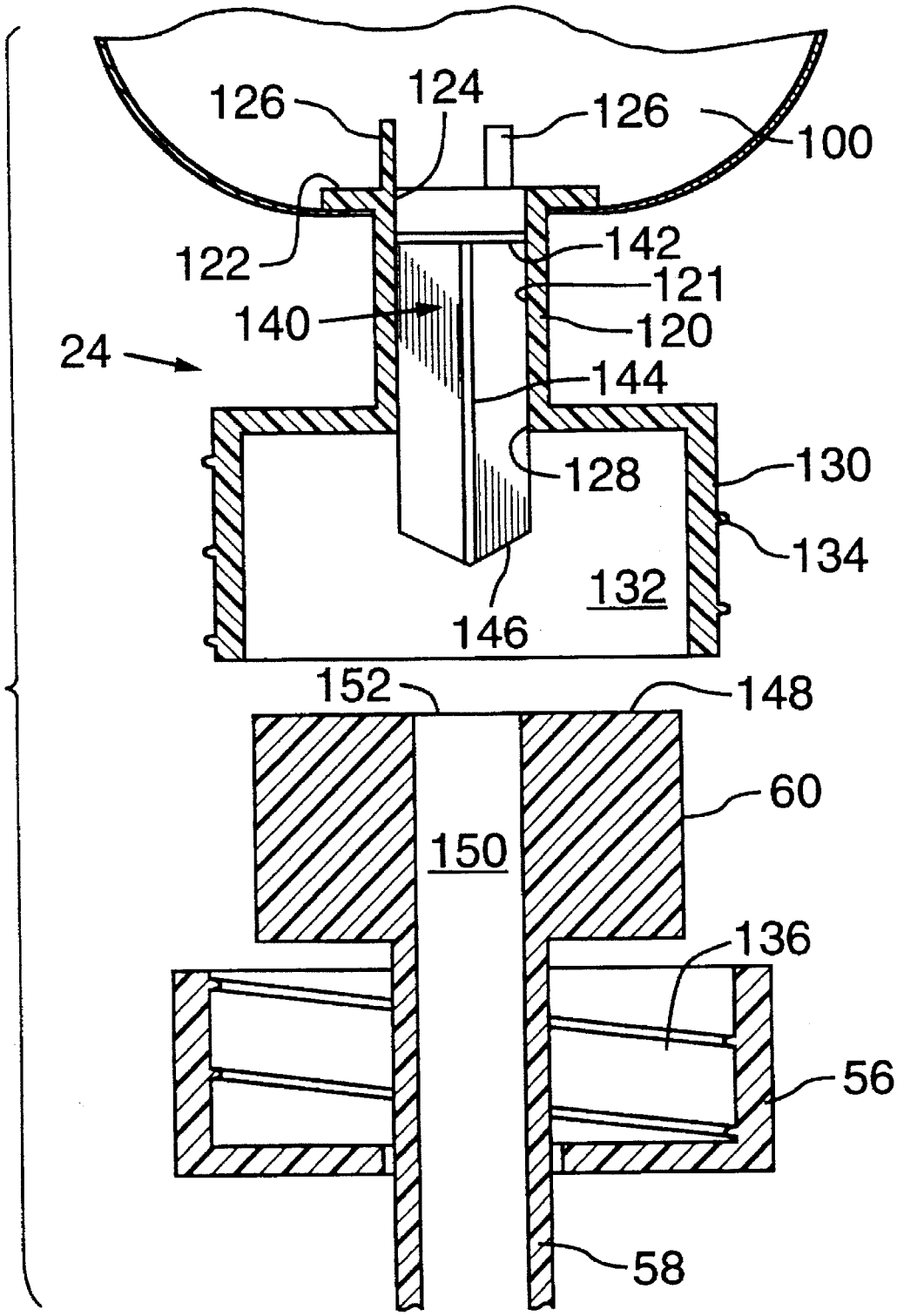
FIG. 14 shows an enlarged cross sectional exploded view of the outlet for the bag shown in FIGS. 11 to 13 secured to the lower end of the bag and the coupling adapted to secure the outlet to the dispenser of FIG. 3.
Figure 15:
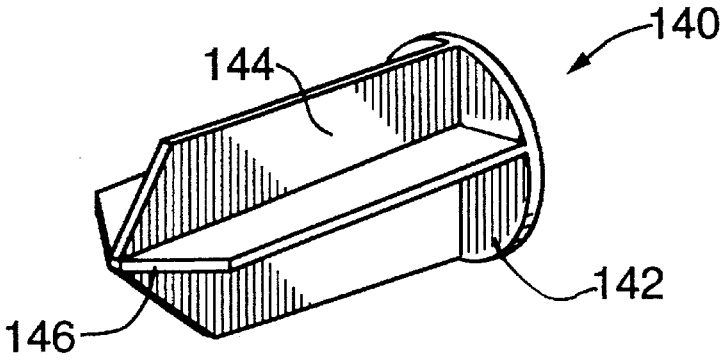
FIG. 15 shows a pictorial view of a stopper for the outlet shown in FIG. 14.
Figure 16:
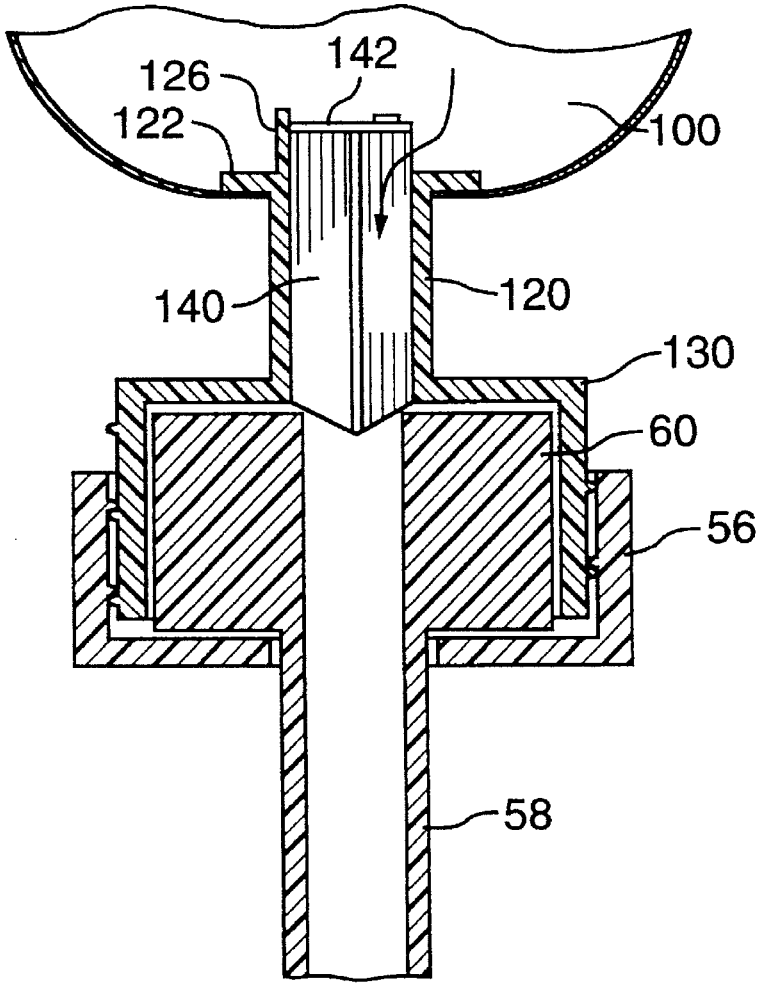
FIG. 16 is a cross sectional side view of the elements of FIG. 14 with the outlet engaged on the coupling.

Reference is now made to FIGS. 14 to 16 which show a preferred construction for the outlet 24 for the bag and for the coupling 26 carried on the base 54 of the dispenser.

The outlet 24 comprises a central outlet tube portion 120 having an annular flange 122 about its upper open end 124 with three equally circumferentially spaced retaining fingers 126 extending axially beyond the upper opening 124. The sheet 100 forming the bag is adapted to be secured to the annular flange 122 to form a fluid tight seal therewith. The outer tube portion 120 has a lower opening 128 about which a cylindrical socket member 130 is disposed. The socket member is sized so as to receive within its cylindrical bore 132 the enlarged annular plug 60 carried on the upper end of feed tube 58. The socket member 130 has external threads 134 to be engaged by internal threads 136 on the threaded collar 56. The threaded collar is axially slidable and rotatable about the feed tube 58. As best seen in FIG. 16, with the enlarged annular plug 60 received within the bore 132 of the socket member, the threaded collar 56, which is free to move axially on the feed tube 58 and rotate thereabout, may manually be drawn upwardly to engage about the socket member 130 and then by rotation of the collar 56, while manually holding the outlet 24 against rotation urge the enlarged annular plug 60 into a sealed relationship within the bore 132 of the socket member 130.

The outlet 24 of a bag which has been manufactured and later filled, may after filling be provided with a stopper 140. Stopper 140 is best seen in FIG. 15.

A bag having an outlet 24 attached but without the stopper 140 inserted may be inverted and then filled with a desired quantity of liquid. When filled, the stopper 140 may be axially slid into the outlet tube portion 120. The stopper 140 has at least one upper annular seal member 142 which is sized to engage in sealing relation the interior surfaces of the complementary cylindrical bore 121 of the tube portion 120 and form a seal substantially preventing flow of fluid out of the bag through the outlet. The stopper 140 has four axially extending locating vanes 144 to assist in accurate location and sliding of the stopper 140 into the outlet tube portion 120.

A bag 16 which has been filed with fluid has a stopper 140 inserted into the outlet tube portion 120 into the position as shown in FIG. 14 with the upper annular seal member 142 disposed in bore 121 between the inlet opening 124 and the outlet opening 128. In this position, the lower end 146 of the stopper extends into the bore 132. In coupling the feed tube 58 to the outlet 24, the enlarged annular plug 60 is inserted into the bore 132 and preferably forms a substantially sealed relation inside the bore 132 once the plug 60 is inserted axially into the bore sufficiently that the upper surface 148 of the plug engages the lower end 146 of the stopper 140. In this regard, as best seen in FIG. 16, the bore 150 through the plug 60 has an inlet 152 which is of a diameter smaller than the diameter of the vanes 144. On the annular plug 60 entering the bore 132 of the socket member and being moved axially therein as it assumes the coupling position shown in FIG. 16, the stopper 140 is displaced from a position in which it seals the outlet tube portion 120 as shown in FIG. 14 to a position in which the stopper 140 permits flow of fluid through the outlet tube portion 120 as seen in FIG. 16. As seen in FIG. 16, the stopper 140 has been moved upwardly within the outlet tube portion 120 such that its upper annular seal member 142 merely engages the upward projections 126 upwardly of the inlet 124 of the outlet tube portion 120 such that fluid may readily flow from the inside of the bag 16 under the upper annular seal member 142 and between the upper projection 126 as indicated by the arrow in FIG. 16.

Preferably, a bag 16 which has been filed with liquid may be stored in an inverted position with the stopper 140 located in a sealing relation as shown in FIG. 14. It is preferable that a seal closure cap (not shown) having a configuration substantially the same as threaded collar 56 but having a completely sealed annular end would be secured to the socket member 130 to seal the same and prevent contamination and reduce the likelihood of leakage.

A preferred bag in accordance with the present invention as shown in FIGS. 10 to 13 is formed from a sheet of plastic foil or laminate comprising an inner layer of 60 microns to 200 microns PE and an outer layer of about 12 microns PET. PE is polyethylene. PET is polyethylene terephthalates. A preferred method of a manufacturing the bag is to be have a continuous roll of such foil punched with spaced holes 104 and fed as a continuous length to a machine to injection mold in place an outlet of polyethylene material which will become fused and/or welded to the PE inside layer, thus ensuring a good seal. Alternatively, the sheet 100 about the hole 104 could be secured by adhesives or directing welding to the annular flange 122 of the outlet 124.

While the present invention shows a preferred bag 16 having a hanger tube 94, it is to be appreciated that many other systems may be used for coupling the bag to the bag support device 14 including openings, holes, grooves and/or slots in the upper end of the bag to be engaged by suitable complementary arrangements on the bag support device 14. The use of the hanger tube 94 disposed within a pocket in the bag is a convenient system however it is to be appreciated that other rigid handle members could be formed as by snap-fitting pairs of locking half handles through holes provided in the bag or by being injection molded or fused thereon in place.

It is preferred that the bag may be formed with merely one opening, that is, the outlet 24 through which fluids may be both injected into the bag and removed therefrom without further manufacture of the bag other than to insert the stopper 140. Of course, this kind of bag could be configured with other outlets and other stopper means, as for example, to have a second opening via which the fluid may be injected.

It is to be appreciated that various systems may be provided so as to adjust the vertical distance the upper end of the bag may be drawn upwardly and the force which draws the upper end of the bag upwardly.

The preferred embodiments show the upper end of the tube and particularly the hanger tube 94 as disposed directly vertically above the outlet 24 and while this is preferred, it is not necessary. A device substantially in accordance with the present invention could also function with for example the upper end of the bag disposed substantially adjacent the frame back 84 or disposed either spaced forwardly or rearwardly of the location of the hanger tube 94 as shown in the drawings.

An advantage of the invention in accordance with the present invention is that since a bag may have its upper end drawn upward at all times so that the sides of the bag are substantially tensioned to prevent lowered pockets forming as shown in FIG. 3, the dispenser as shown in FIG. 4 may be provided with a window 54 through which a visual inspection of the bag will readily determine whether or not a bag may be empty and as well will permit instructions, labelling, and the like which may be printed on the flat sides 20 of the bag to be readily read and understood whether or not the bag may be full, partially empty or completely empty.

The preferred embodiment of FIGS. 4 to 16 shows the outlet 24 as having a threaded socket member adapted to be engaged by the threaded collar 56 to couple the outlet of the bag to the dispenser. It is to be appreciated many other coupling systems including bayonet type and the like may be used. In use of the device in accordance with the present invention, it is preferred that the upper end of the bag will be coupled to the bag support device 14 first and thereafter the outlet 24 will then be coupled to the base 54 of the dispenser, although this is not necessary.

The preferred embodiment of FIGS. 4 to 16 illustrates the outlet 24 as being adapted for coupling via the coupling 26 to a pump 28. It is within the scope of the present invention that the outlet 24 may form a portion of the pump and/or the entire pump assembly. In this regard, constructions of pumps and couplings for pumps and covers thereto as disclosed in the applicant's U.S. Pat. Nos. 5,282,552 issued Feb. 1, 1994 and 5,373,970 issued Dec. 20, 1994 may be incorporated in conjunction with the bag and dispensing device in accordance with the present invention. The disclosures of U.S. Pat. Nos. 5,282,522 and 5,373,970 are incorporated herein by reference.

Figure 17:
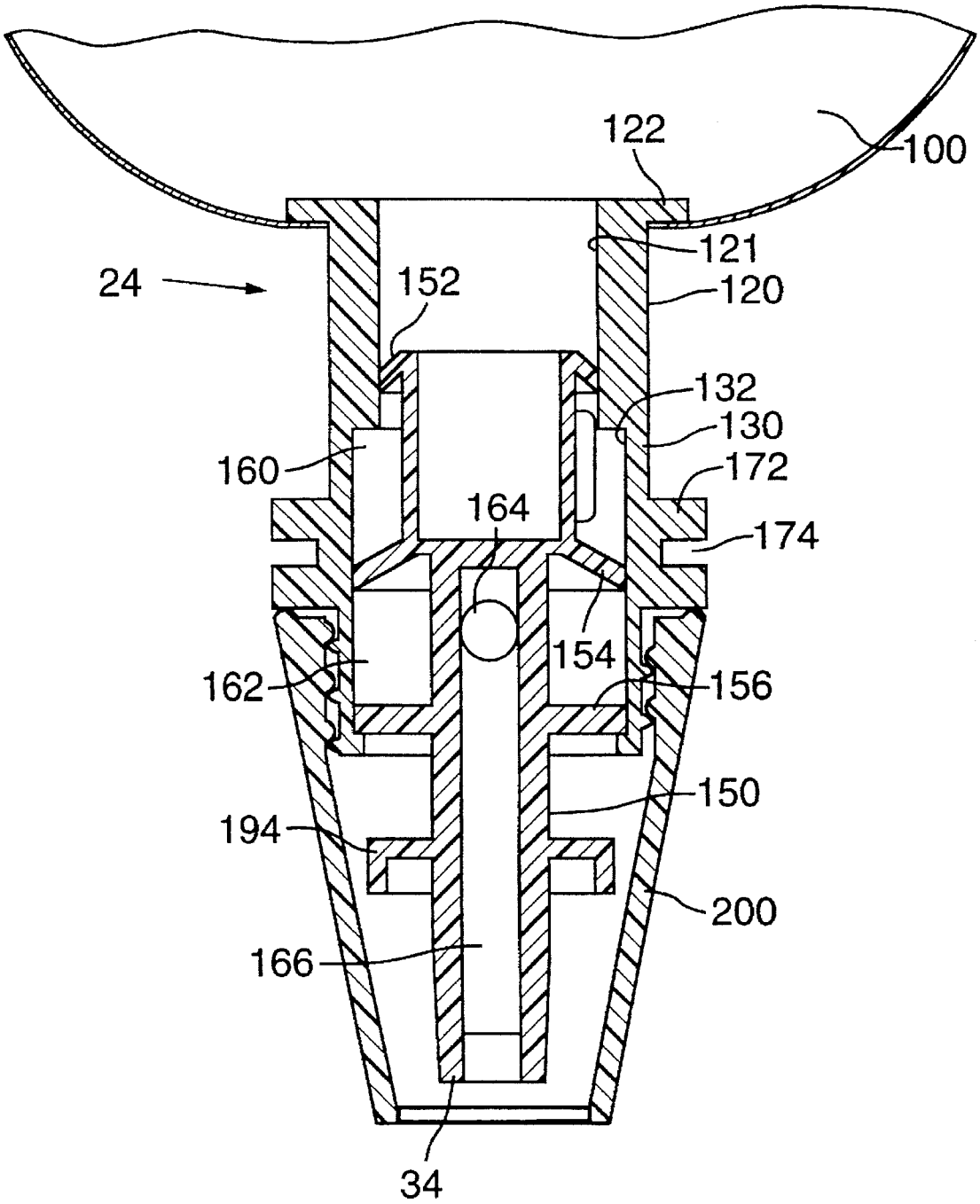
FIG. 17 shows an enlarged cross sectional exploded view of a second embodiment of an outlet for a bag in accordance with the present invention.

Reference is now made to FIG. 17 which shows an outlet 24 for use in accordance with the present invention and incorporating a pump of the type illustrated in FIG. 11 of U.S. Pat. No. 5,282,522.

As seen in FIG. 17, the outlet tube portion 120 has an inner bore 121 of a smaller diameter than the bore 132 of the socket member 130. A piston 150 has an inner flexing disk 152 sealably engaging the bore 121 and permitting fluid flow downwardly therepast only. An outer flexing disk 154 sealably engages bore 132 and permits fluid flow outwardly therepast only. Sealing disk 156 engages bore 132 and prevents any fluid flow therepast. On moving the piston 150 inwardly, fluid is urged from a chamber 162 between disks 152 and 154 into a chamber 162 between disks 154 and 156 and then out of the pump via radially extending opening 164 which connects chamber 162 with an axially extending passage 166 opening to the outlet nozzle 34.

FIG. 17 shows a removable closure cap 200 threadably engaged on the socket portion 130. The upper end of flange 122 of the outlet tube portion 120 preferably has the foil 100 for the bag welded directly thereto.

Figure 18:
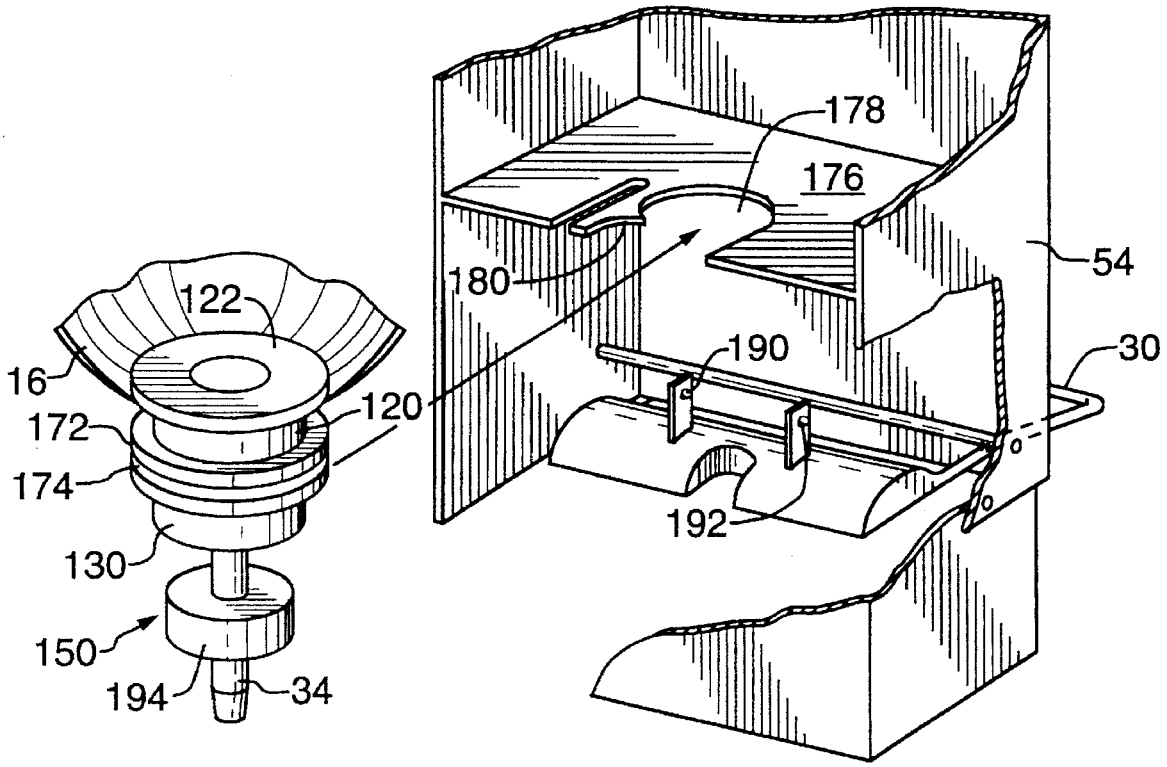
FIG. 18 is a partial cross sectional side view showing the outlet of FIG. 17 in combination with a further embodiment of a base of a housing adapted for use therewith.

Reference is now made to FIG. 18 which shows the device of FIG. 17 with the closure cap 200 removed ready for insertion into the base 54 of a housing in accordance with the device of FIG. 6 of U.S. Pat. No. 5,373,970. With the closure cap removed and the upper end of the bag supported on the bag support device, the outlet assembly 24 of FIG. 17 may be slid rearwardly to engage the base 54. In this regard, FIG. 17 shows the socket member 130 as having an enlarged annular boss 172 carrying a slot 174. The base 54 has a support web 176 with an opening 178 adapted to be received in the slot 174 to fixedly secure the outlet 24 to the base 54. As shown, the support web 176 preferably has a resilient entrance catch 180 which will resiliently deflect to the side outwardly from the opening 178 to permit insertion of the outlet assembly 24 into and out of the opening 178 under manually applied force.

As taught by U.S. Pat. No. 5,373,970, by such simple sliding of the outlet assembly 24 into the base 54 shown in FIG. 18, fingers 190 and 192 and the lever actuator 30 come to engage the flange 194 on the piston 150 so that actuation of the lever actuator 30 will move the piston inwardly and outwardly and thereby pump fluid from the bag.

FIG. 17 shows an embodiment in which each bag may be provided with the totally disposable pump, it is to be appreciated that a bag as shown in FIG. 17 could be provided without the piston 150 and instead have a removable stopper such as 140 shown in FIG. 15 provided in bore 121 of the outlet tube portion 120. To couple the outlet to the dispenser, a piston 150 which may be a reusable part of the dispenser could be pushed upwardly into the bores 131 and 121 thus suitably displacing the stopper 140 inwardly and permitting fluid flow therepast.

It is to be appreciated that the bag and dispenser may be adapted to have a permanent pump and dispenser or a disposable bag in the bag or other configurations as, for example, with only part of the pump being provided on the bag and dispensed after one use.

The illustrated embodiments show a system in which the lower end of the bag is secured to the dispenser via the outlet. The lower end may be secured to the dispenser otherwise, as for example, by the lower corners of the bag on either side of the outlet. Alternate bags could have a similar hanger tube 90 secured in the lower end with the outlet adjacent thereto on one side.

The illustrated embodiments shown in FIGS. 1 to 17 show the bag being tensioned by drawing the upper end upwardly. Suitable tensioning of the bag arises by relative movement of the upper end and the lower end away from each other. Thus, tensioning may be provided by drawing the lower end downwardly. In this regard, as seen in FIG. 1, either in addition to or alternatively two elastic cord 38 drawing the upper end of the bag upwardly, the pump and its coupling could be mounted for spring loaded movement downward relative to the dispenser housing so as to draw the outlet downwardly. While it is preferred that the bag be tensioned by engaging the bag and applying tensioning at its upper or lower end, tensioning forces could be applied between the upper end and the lower end, for example, on the side walls. With portions of the side walls approximate the outlet drawn upwardly, a similar advantageous result could be obtained.

Figure 19:
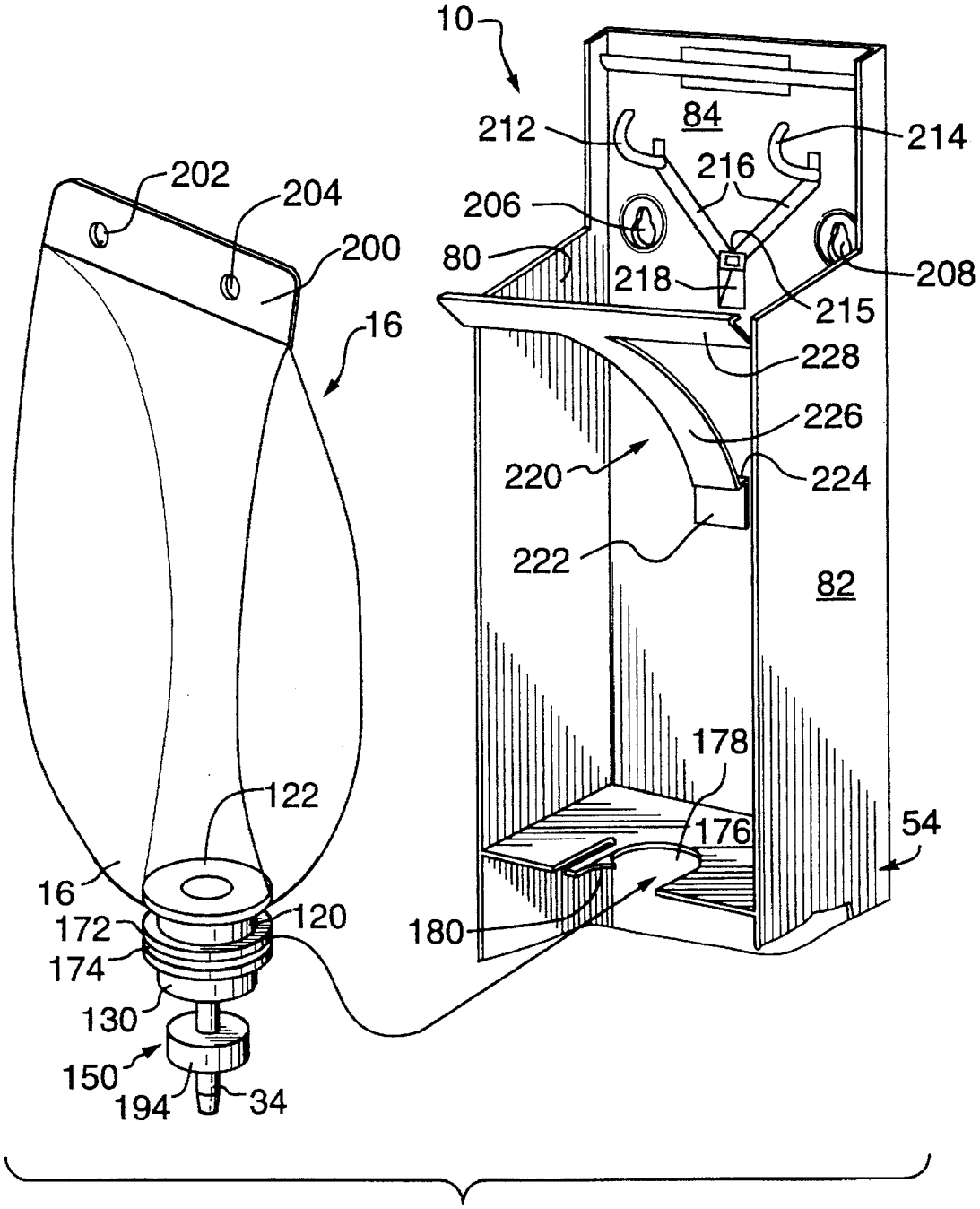
FIG. 19 is a partial cross sectional exploded pictorial view of a dispenser and a bag in accordance with a second aspect of the invention.
Figure 20:
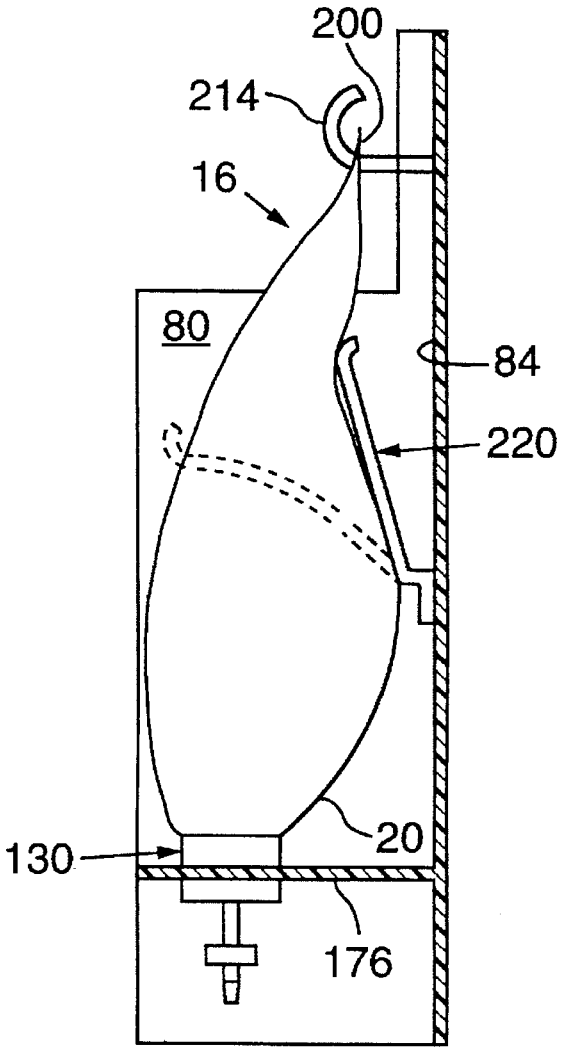
FIGS. 20 and 21 show similar partial side views of the dispenser of FIG. 19, in FIG. 20 with the bag being full and in FIG. 21 with the bag being nearly empty.
Figure 21:
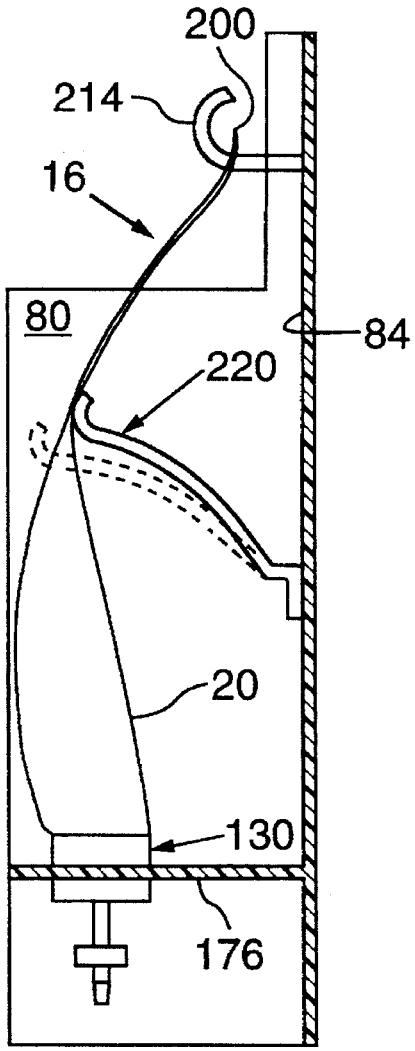

Reference is now made to FIGS. 19 to 21 which shows an exploded view of a dispenser and bag in accordance with a third aspect of this invention. The bag 16 is substantially the same as the bags illustrated with the other embodiments and, notably, having an outlet as illustrated in FIG. 17, however, with the significant difference that the top of the bag is provided with a sealed and reinforced area generally indicated 200 which has two circular holes therethrough 202 and 204. As well, the bag 16 in FIG. 19 is illustrated to have partially gossetted sides.

The wall mounted dispenser 10 has a vertical frame comprising side frames 80 and 82 connected by back frame 84. Back frame 84 has screw openings 206 and 208 to receive screws to mount the dispenser to a wall. The back frame 84 carries two hook members 212 and 214 which extend forwardly and upwardly from the back frame 84. The hook members are preferably formed as opposite ends of a generally U-shaped rod member, the remainder of which is positioned rearward of the frame back 84 within suitably sized forwardly directed slots 216 in the back frame 84 and with a central bight portion 215 of this rod member engaged forward of a rearwardly bent tongue 218 of the back frame 84 which tongue 218 engages a rear surface of the bight portion 215 preventing movement rearwardly.

The lower portion of the dispenser 10 is illustrated to have a base 54 with a support web 176 with an opening 178. The web 176 is adapted to be received in a slot 174 of the bag's socket member 130 so as to secure the lower end of the bag 16 to the dispenser in a manner substantially the same as that described in association with FIGS. 17 and 18. For simplicity, FIG. 19 does not illustrate a mechanism to activate the piston pump 150 incorporated into the socket member 130.

The rear frame 84 is shown as carrying a tensioning member 220. The tensioning member is a "T"-shaped member formed of spring steel and having a lower end portion 222 secured to the rear frame 84 as by welding. The tensioning member 220 is shown at its lower end to be bent forming a generally horizontally extending short leg 224 which extends outwardly of the rear frame 84 to a generally upwardly extending major spring portion 226. The spring portion 226 carries at its upper end, an enlarged width contact portion 228. The contact portion 228 has an upwardly and forwardly directed surface which is rounded and is adapted to engage rearwardly directed surfaces of the side walls 20 of the bag 16.

To insert the bag onto the dispenser, the upper end of the bag is secured onto the hooks of the dispenser by the holes 202 and 204 being engaged about the hooks 212 and 214. A person then engages the lower end of the bag and, particularly, the socket member 130 to the dispenser by drawing the bag downwardly so as to engage the socket member 130 within the opening 178 of the support web 176 of the dispenser with the edge of the support web 176 being received within the slot 174 of the socket member 130. In so attaching a bag, the contact portion 228 of the tensioning member 220 is engaged by the bag 16 and the tensioning member 220 is displaced rearwardly towards the rear frame 84. In this regard, reference is now made to FIGS. 20 and 21.

Both FIGS. 20 and 21 illustrate, in dotted lines, the position of the tensioning member 220 in an unbiased fully forwardly extended position to which the tensioning member 220 is inherently biased. FIG. 20 shows the dispenser supporting a bag 16 which is full and with the rearmost side wall 20 of the bag engaging the tensioning member 220 and causing tensioning member 220 to bend rearwardly such that the tensioning member 220 assumes a retracted and rearwardly deflected position. As shown, the tensioning member 220 is deflected substantially by bending of the spring portion 226. The bag 16 exerts rearward forces onto the tensioning member 220 and the bias of the tensioning member 220 exerts opposite forces on the side wall of the bag and urges the side wall of the bag substantially horizontally forwardly so as maintaining tension in the bag between the upper end and the outlet end both of which are fixedly secured to the dispenser.

As the fluid is dispensed from the bag, the forces the bag exerts onto the tensioning member 220 decreases and the tensioning member deflects from the rearwardly retracted position towards the forwardly extended position, taking up slack in the side walls so as to maintain tension in the rearward side walls between the upper end and the outlet of the bag.

As seen in FIG. 21, when fluid has been dispensed to an extent that the bag is substantially empty, the tensioning member 220 has deflected substantially toward the forwardly extended position and is sufficiently forward that tension is maintained in the side walls of the bag. This tensioning of the side walls of the bag assists in maintaining material to be dispensed within the bag substantially above the outlet.

It is to be appreciated that the spring member 226 and particularly the biasing spring forces which may be developed by the spring portion 226 can be varied having regard to the configuration and nature of the materials forming the tensioning member. The spring forces developed by the tensioning member need only be sufficient such that the tensioning member will tension the side walls of the bag when it is substantially empty.

The tensioning member is specifically illustrated in FIG. 19 and is shown with an end portion 222 secured to the rear frame 84 and the contact portion 228 biased to extend upwardly and forwardly from the rear surface 84. It is to be appreciated that a similar arrangement would be useful with the tensioning member inverted having its end portion 220 disposed above the contact portion 228. However, as seen in FIG. 21, it is preferred that the tensioning member engage the bag at a higher location so as to assist in ensuring that fluid does not become trapped in the bag above the point where the tensioning member engages the bag and may urge both forward and rearward sides of the bag into contact with each other.

When inserting a bag into the dispenser, it is to be appreciation that either the upper end of the bag may first be secured to the dispenser followed by securing of the outlet end to the dispenser or, alternatively, that the outlet of the bag may first be secured to the dispenser followed by engagement of the upper end. However, with the configuration shown in FIG. 19 and utilizing a tensioning member which deflects under relatively low forces, by merely hanging the bag onto the hooks 212 and 214, the weight of the fluid in the bag hanging downwardly will substantially deflect rearwardly a preferred tensioning member 220 and little or no manual downward tension may be required to couple the outlet 130 to the dispenser.

The tensioning member 220 is shown as coupled to the rear frame 84. It is to be appreciated that a similar tensioning member could be coupled to a front frame of a removable top and front cover for the dispenser such that tension would only be applied once the cover is in place. Similar tensioning members could also be coupled to one or both of the side wall members 80 and 82.

The tensioning member 220 is shown as having contact portion 228 which extends substantially the width of the bag. This is advantageous so as to assist in directing the tensioning forces over the whole width of the bag. This is not, however, necessary. The tensioning member 220 is shown as having a spring portion 226 which is relatively thin in a side-to-side direction compared to the contact portion 228. Of course, the spring portion 226 could be of the same width as the upper portion 228. Where a dispenser is provided, as illustrated in FIG. 4, with a front opening for visual inspection of the product inside, having the tensioning member urge the bag forwardly is of assistance in presenting the bag close to the window 54 assisting visual inspection and improving the appearance, particularly, when substantially empty as shown in FIG. 1.

It is to be appreciated in the context of FIG. 19 that the tensioning member in forcing the side walls of the bag forwardly, tensions the side walls of the bag and, thus, draws a portion of the side walls proximate the outlet opening upwards relative the outlet opening which assists in placing fluid in the bag in a position to be dispensed from the outlet.

In the preferred embodiment illustrated in FIGS. 19 to 21, the tensioning member displaces the bag 16 laterally, that is, generally horizontally and forwardly. It is to be appreciated that in a similar device, the bag could be displaced horizontally either rearwardly or laterally from either side. It is also to be appreciated that a tensioning member could displace the bag in a direction which has, at least, a part horizontal component which would assist in tensioning the bag as, for example, in the tensioning member displacing the bag upwardly and forwardly.

In a device such as illustrated in FIG. 19, the relative sizes and dimensions of the bag, when full and empty, the relative distance between the hook members 212 and 214 and the opening 178 on the dispenser, the relative positioning, resiliency and dimensions of the tensioning member, and the density of the fluid must be considered to provide a device which functions advantageously as described.

A device in accordance with the present invention may incorporate both a tensioning device to draw a bag upwardly as in FIGS. 1 or 4 with a tensioning device to displace a bag laterally as in FIG. 19.

As used herein, the term "fluid" means any flowable matter and includes liquids, flowable pastes and flowable solids such as dry flowable powders and the like.

While the invention has been described with reference preferred embodiments, the invention is not so limited. Any modifications and variations will now occur to a person skilled in the art. For a definition of the invention, reference is made to the appended claims.

What we claim is:

1. In combination dispensing apparatus and replaceable bag means containing fluid to be dispensed therefrom:

the bag means having an upper end and a lower end joined by collapsible side walls, hanging means on the upper end of the bag means, outlet means on the lower end of the bag means for exit of said fluid from the bag means, said dispensing apparatus having bag suspending means to suspend the bag by engaging the hanging means on the upper end of the bag means, dispensing means for fixedly holding the outlet means at a height below the upper end of the bag means, tensioning means to sufficiently tension the side walls between the lower end and the upper end of the bag means to direct fluid in the bag to assume positions disposed in the bag above the outlet means.

2. A combination as claimed in claim 1 wherein the dispensing means holds the outlet means generally vertically below the hanging means such that the bag means extends substantially vertically therebetween, the tensioning means comprises spring means which engage the side walls of the bag means between the upper end and the lower end of the bag to urge the side walls generally horizontally relative the upper end and lower end thereby tensioning the side walls between the hanging means and outlet means.

3. A combination as claimed in claim 2 wherein tensioning means operates to draw portions of the side walls approximate the outlet means upwardly relative the outlet means.

4. A combination as claimed in claim 1 wherein the tensioning means comprises spring means for biasing the suspending means upwardly thereby to draw opposite sides of the bag together and direct fluid in the bag to positions disposed in the bag above the outlet; and including stop means preventing the bag suspending means from permitting the upper end of the bag to assume a position below a minimum height position.

5. The combination as claimed in claim 4 wherein the dispensing means holds the outlet means generally vertically below the hanging means such that the bag extends substantially vertically therebetween.

6. The combination as claimed in claim 1 wherein the bag means comprises a bag means with two substantially identical flexible side walls joined to each other at their periphery.

7. The combination as claimed in claim 6 wherein the bag means has an outlet disposed in the center of the lower end of the bag means and seams joining the edges of the side walls together which means extend at an angle from the outlet means upwardly to assist in directing fluid in the bag towards the outlet means.

8. A combination as claimed in claim 2 wherein the apparatus includes a generally vertically disposed support plate, the suspending means carried on the support plate, the spring means carried on the support plate below the supporting means, the spring means comprising an elongate member with one end secured to the support plate and the other distal end carrying a bag contact portion for engagement of side walls of the bag means, the spring means located between the bag means and the support plate, the spring means biased to assume an unbiased position in which the bag contact portion is located forward of the support plate such that in engagement between the bag means and the bag contact portion the bag contact portion urges the side walls of the bag means forwardly relative the support plate and the side walls of the bag means reactively urges the bag contact portion rearwardly towards the support plate.

9. A combination as claimed in claim 8 wherein the spring means comprises an elongate member of spring metal fixedly secured at its one end to the support plate and wherein in the unbiased portion it extends forwardly and an angle to the vertical.

10. A combination as claimed in claim 9 wherein in the unbiased position the elongate member extends forwardly and upwardly.

11. A combination as claimed in claim 10 wherein with increased rearward deflection of the elongate member by engagement with the side walls of the bag means the side walls of the bag means come to engage additional portions of the elongate member closer to the one end.

12. A combination as claimed in claim 8 including coupling means carried on the support plate below the spring means wherein the bag means is manually removably coupled to the support means to fixedly secure the outlet means relative the support plate.

13. A combination as claimed in claim 8 wherein the suspending means comprises hook members and the hanging means comprises opening in a sealed flange on an upper end of the bag means.

14. A combination as claimed in claim 13 wherein the outlet means on the bag means is manually insertable and removable from the dispensing means.

15. A combination as claimed in claim 14 wherein the coupling means, spring means and hook member are juxtaposed having regard to the configuration of the bag means that with the outlet means of the bag means coupled to the coupling means, manually engaging the hanging means on the hook member causes the side walls of the bag means to engage the contact portion of the spring means and urge the spring means against its bias rearwardly towards the support plate.

16. A combination as claimed in claim 14 wherein said coupling means comprises a support plate with an opening therethrough sized to engage with portions of the bag means proximate the lower end of the bag means to prevent upward movement of lower end of the bag means.

* * * * *